US007611272B2

(12) United States Patent
Specht et al.

(10) Patent No.: US 7,611,272 B2
(45) Date of Patent: Nov. 3, 2009

(54) LIGHT UNIT FOR HIGH-BEAM AND LOW-BEAM GENERATION

(75) Inventors: Stephanie Specht, Stuttgart (DE); Andreas Leittretter, Denkendorf (DE)

(73) Assignee: odelo GmbH, Schwaikheim (DE)

( * ) Notice: Subject to any disclaimer, the term of this patent is extended or adjusted under 35 U.S.C. 154(b) by 92 days.

(21) Appl. No.: 11/857,708

(22) Filed: Sep. 19, 2007

(65) Prior Publication Data

US 2008/0080201 A1 Apr. 3, 2008

(30) Foreign Application Priority Data

Sep. 19, 2006 (DE) ..... 10 2006 044 640

(51) Int. Cl.
*F21V 7/04* (2006.01)

(52) U.S. Cl. ..... 362/555; 362/556; 362/511; 385/121

(58) Field of Classification Search ..... 362/554–556, 362/511, 26–27; 385/121, 88–94
See application file for complete search history.

(56) References Cited

U.S. PATENT DOCUMENTS 5,327,328 A * 7/1994 Simms et al. ..... 362/26
6,527,411 B1 3/2003 Sayers
7,286,296 B2 * 10/2007 Chaves et al. ..... 359/641
2004/0090602 A1 * 5/2004 Imade ..... 353/102

OTHER PUBLICATIONS

U.S. Appl. No. 10/551,412, filed Jan. 11, 2007.
U.S. Appl. No. 11/213,515, filed Apr. 20, 2006.

* cited by examiner

*Primary Examiner*—Jacob Y Choi
*Assistant Examiner*—Robert May
(74) *Attorney, Agent, or Firm*—Reising Ethington P.C.

(57) ABSTRACT

The invention concerns a light unit with at least one LED, including at least one light-emitting chip as light source, with primary optics that include at least one fiber-optic element, optically connected after the LED, and with secondary optics, optically connected after the fiber-optic element. For this purpose, the light unit includes a second LED with at least one light-emitting chip as light source. The primary optics includes a second fiber-optic element, optically connected after the second LED and optically connected before the secondary optics. The light outlet surfaces of the two fiber-optic elements are adjacent to each other at a partition.

With the present invention, a light unit with high light output is developed, both for low beams and high beams, which requires limited space.

12 Claims, 7 Drawing Sheets

LIGHT UNIT FOR HIGH-BEAM AND LOW-BEAM GENERATION

BACKGROUND ART

1. Field of the Invention

The invention concerns a light unit with at least one LED, which includes at least one light-emitting chip as light source, with primary optics that includes at least a fiber-optic element, optically connected after the LED, and with secondary optics, optically connected after the fiber-optic element.

2. Description of Related Art

This type of light unit is known from DE 103 14 524 A1. Several identical light units are arranged in a headlight, in which the individual light unit contributes either to low-beam generation or high-beam generation.

The problem underlying the present invention is therefore to develop a light unit with high light output both for low beams and high beams, which requires limited space.

SUMMARY OF THE INVENTION

This problem is solved with the features of the main claim. For this purpose, the light unit includes a second LED with at least one light-emitting chip as light source. The primary optics includes a second fiber-optic element, optically connected after the second LED and optically connected in front of the secondary optics. The light outlet surfaces of the two fiber-optic elements are adjacent to each other in a partition.

BRIEF DESCRIPTION OF THE DRAWINGS

Additional details of the invention are apparent from the dependent claims and the variants schematically depicted in the following description.

DETAILED DESCRIPTION OF THE PREFERRED EMBODIMENT(S)

Figure 1:
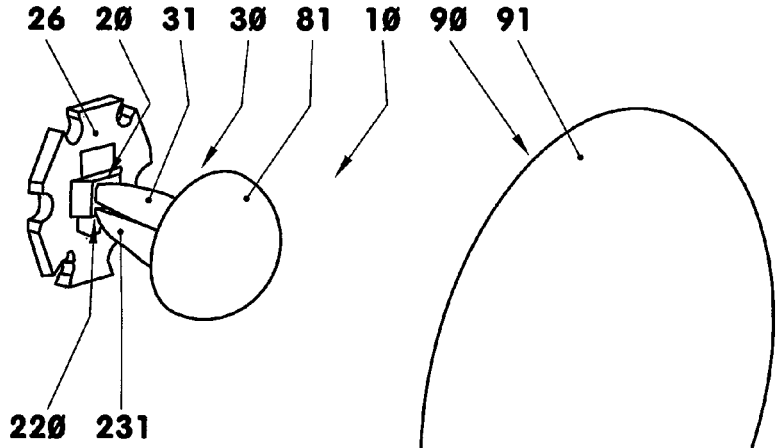
FIG. 1: Diametric view of a light unit.
Figure 2:
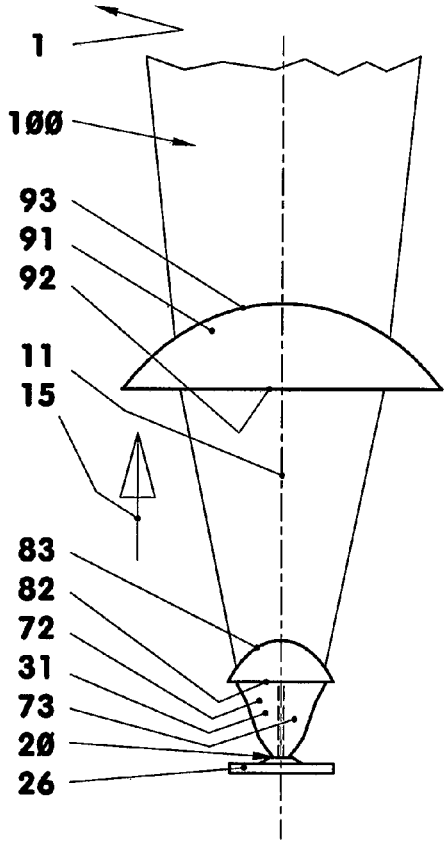
FIG. 2: Top view of FIG. 1.

FIGS. 1 and 2 show a light unit (10), for example, a light module (10) of a vehicle headlight, in a diametric view and in a top view. The light module (10) includes, for example, first (20) and second (220) luminescent diodes, primary optics (30) and secondary optics (90). The light propagation direction (15) is oriented from luminescent diodes (20, 220) in the direction of secondary optics (90). The optical axis (11) of light module (10) intersects the geometric center of the luminescent diodes (20, 220) and passes through the primary (30) and secondary optics (90).

Figure 3:
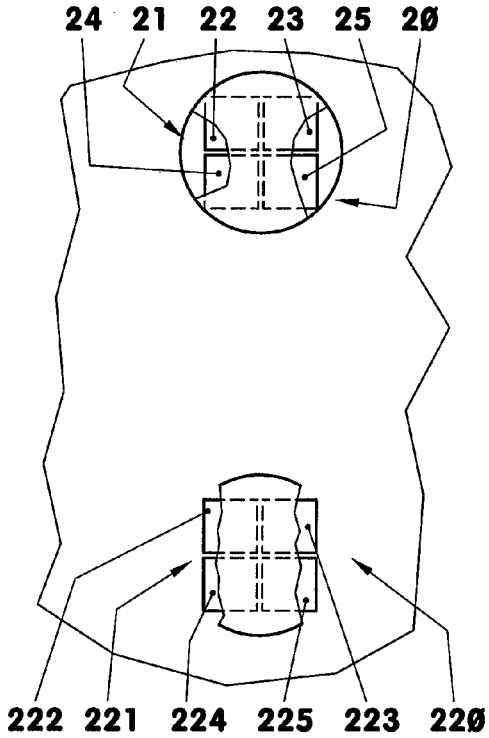
FIG. 3: Arrangement of light sources.

The individual luminescent diode (20, 220), for example, is an LED (20, 220) that sits, for example, in a base (26). In the depiction of FIG. 3, which shows the arrangement of first (22-25) and second (222-225) light sources, the first LED (20) is arranged on the top and the second LED (220) on the bottom. The center spacing of the two LEDs (20, 221) to each other is, say, 7.5 millimeters.

Each of the LEDs (20, 220) in this practical example includes a group (21, 221) of four light-emitting chips (22-25; 222-225), which are arranged in a square. Each of the light sources (22-25; 222-225) therefore has two directly adjacent light-emitting chips (23, 24; 22, 25; 22, 25; 23, 24; 223, 224; 222, 225; 222, 225; 223, 224). The light-emitting chips (22-25, 222-225) of groups (21; 221) can also be arranged in a rectangle, in a triangle, in a hexagon, in a circle, with or without a center light source, etc. The individual light-emitting chip (22-25; 222-225) in this practical example is square and has an edge length of a millimeter. The distance of the light-emitting chips (22-25; 222-225) of a group (21; 221) relative to each other is a tenth of a millimeter. A variant with an individual light-emitting chip (22; 23; 24; 25; 222; 223; 224; 225) is also conceivable. The LEDs (20, 220) here have a transparent body, which has a length of, say, 1.6 millimeters in the light propagation direction (15) from base (26).

The primary optics (30) in the practical example depicted in FIGS. 1 and 2 include first (31) and second (231) fiber-optic elements arranged one above the other and an optical lens (81) connected after the fiber-optic elements (31, 231) in the light propagation direction (15). The first fiber-optic element (31) on the top, for example, is optically connected after the first LED (20), the second fiber-optic element (231) on the bottom is arranged between the second LED (220) and the optical lens (81). The distance from the fiber-optic elements (31, 231) to the LEDs (20, 220), for example, is a few tenths of a millimeter, for example, between 0.2 millimeter and 0.5 millimeter. The intermediate spaces (16, 216), cf. FIG. 8, between the fiber-optic elements (31, 231) and the LEDs (20, 220) can be filled, for example, with a silicone-like transparent material.

The two fiber-optic elements (31, 231), for example, are plastic elements made from a highly transparent thermoplastic, for example, polymethylmethacrylate (PMMA) or polycarbonate (PC). The material of the fiber-optic element (31, 231) formed, for example, as a solid element, has a refractive index of 1.49. The two fiber-optic elements (31, 231) in this practical example have the same length, the same width and the same height. The main dimensions, however, can also differ. The length of the fiber-optic element (31, 231) in this practical example is 13.5 millimeters. The fiber-optic element (31, 231) of the light unit (10) described here can also have a length between 15 and 16 millimeters.

Figure 4:
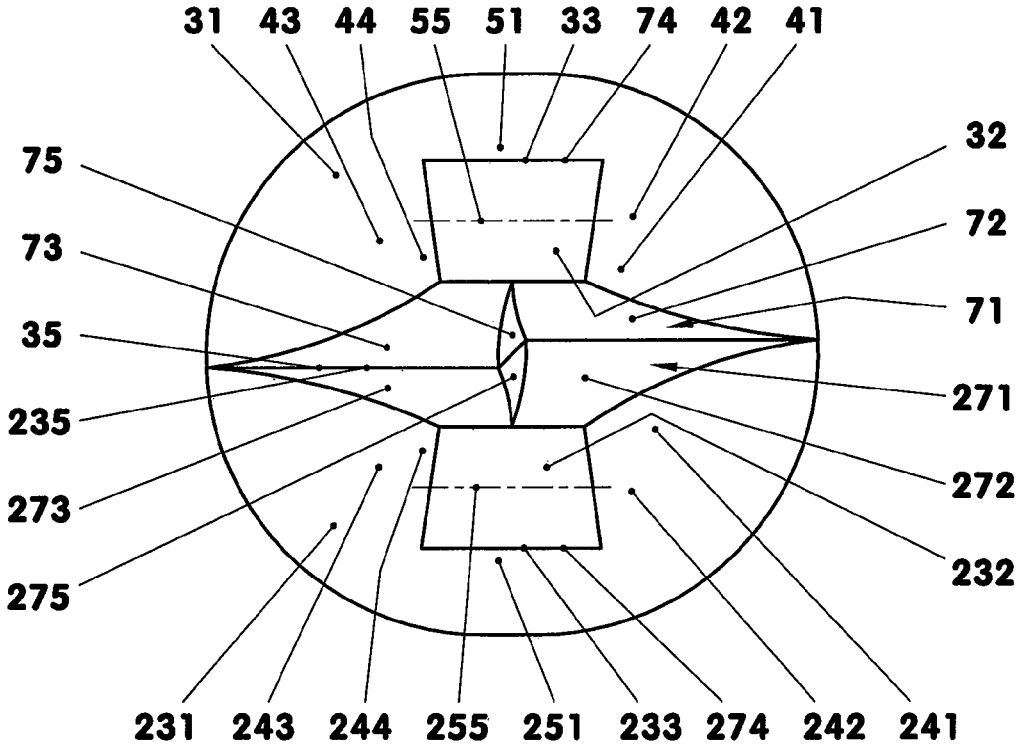
FIG. 4: View of the fiber-optic element from the light entry side.
Figure 5:
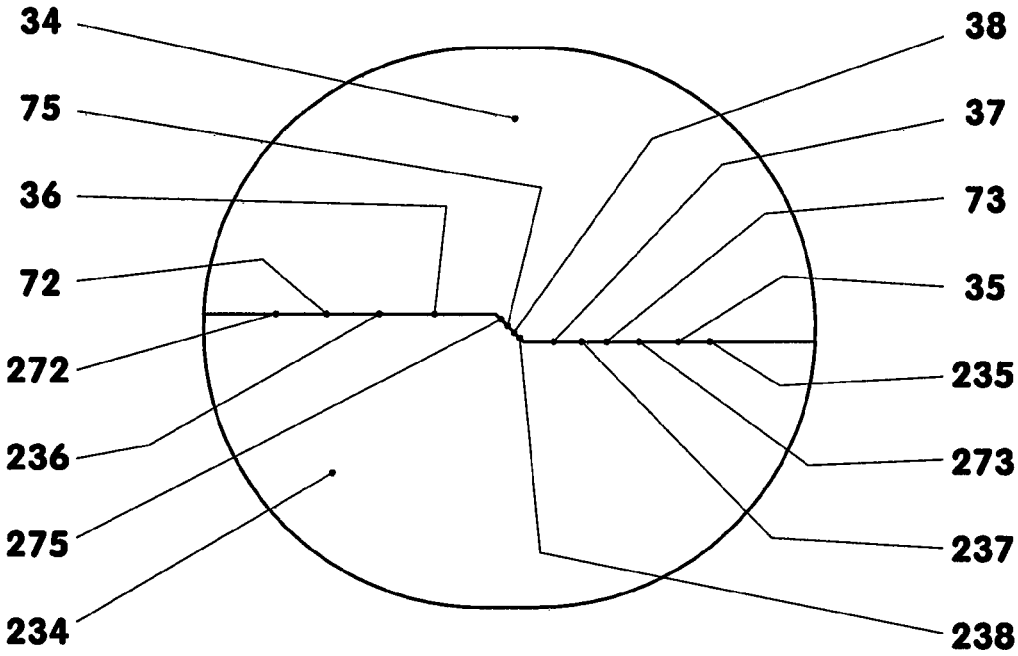
FIG. 5: View of the fiber-optic element from the light outlet side.
Figure 6:
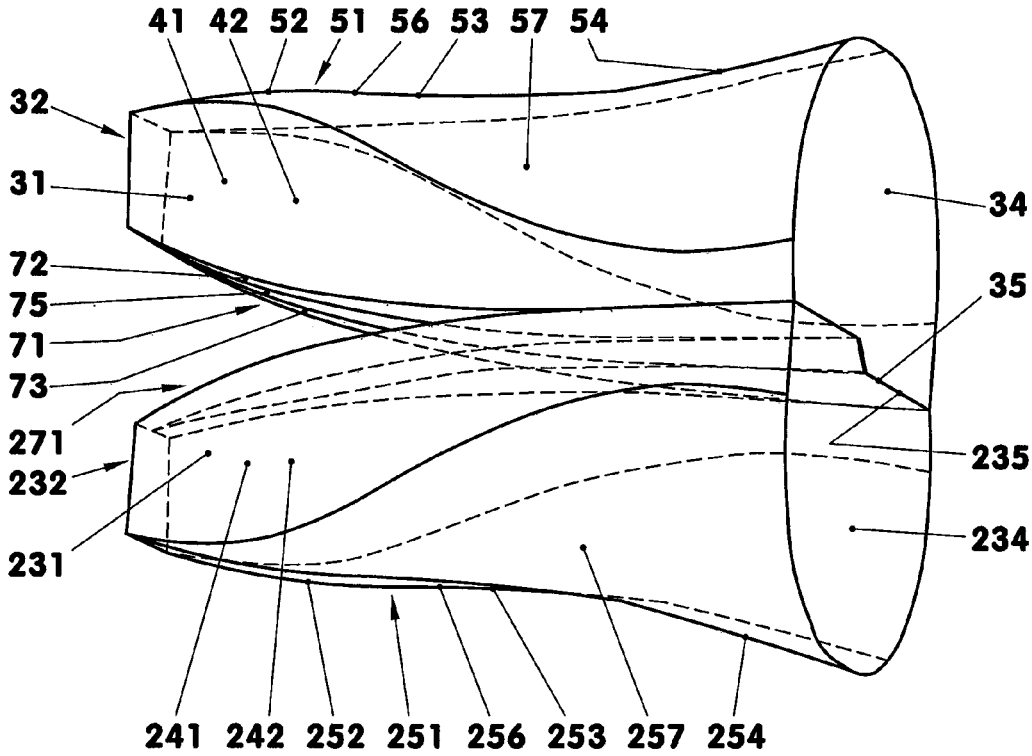
FIG. 6: Diametric view of the fiber-optic element.
Figure 7:
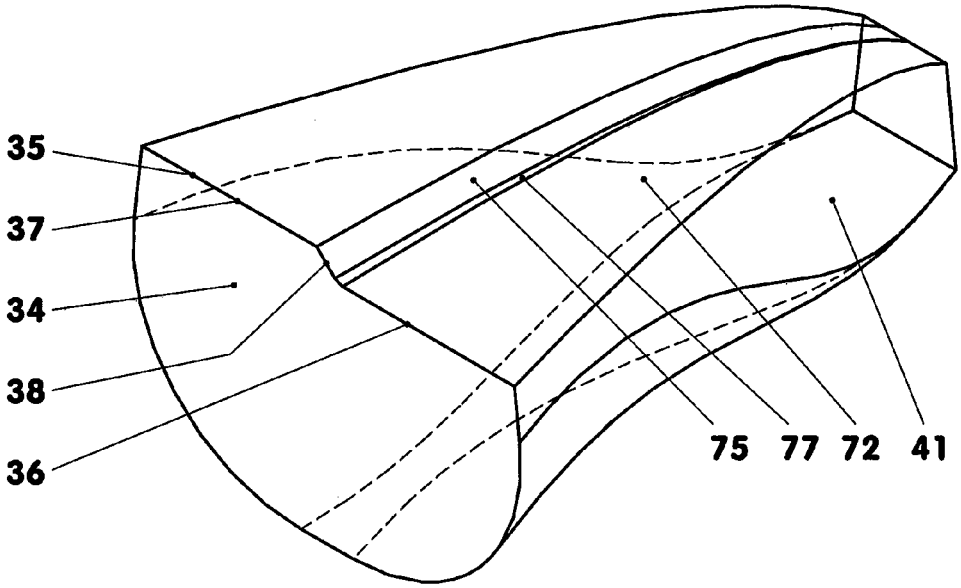
FIG. 7: Diametric view of the fiber-optic element from below.

The fiber-optic elements (31, 231) are shown in different views in FIGS. 4-7. FIG. 4 shows a view of the fiber-optic elements (31, 231) from first (32) and second (232) light entry sides. The fiber-optic elements (31, 231) in FIG. 5 are shown in a view from the light outlet sides (34, 234). FIG. 6 shows a diametric view of the fiber-optic elements (31, 231) and FIG. 7 shows a diametric view of the upper fiber-optic element (31) from below. In the practical examples shown here, the two fiber-optic elements (31, 231) are at least roughly identical and rotated relative to each other by 180 degrees around optical axis (11), in which the light outlet sides (34, 234) are adjacent to each other.

The light entry surfaces (32; 232) facing light sources (22-25; 222-225) and the light outlet sources (34, 234) facing away from light sources (22-25; 222-225) are arranged parallel to each other and normal to optical axis (11) in this practical example. The light entry surfaces (32, 232) and the corresponding light outlet sources (34, 234) can also be sloped relative to each other. The corresponding light entry surface (32, 232) is a trapezoidal, flat surface here. The short baseline of the upper light entry surface (32), which has a length of, say, 2.4 millimeters, is arranged on the bottom. The long baseline of this surface (32) on the top is, say, 3.02 millimeters long. The lower light entry surface (232) has the same dimensions and is designed inversely, so that the short baselines of the two light entry surfaces (32, 232) are oriented toward each other in this practical example. The area of a light entry surface (32, 232) is 5.5 square millimeters. The light entry surfaces (32, 232) can also be designed square, rectangular, etc.

The light outlet surfaces (34, 234) each have an area of 44 square millimeters. Their height here is 5.8 millimeters, their maximum width (this is also the maximum width of the corresponding fiber-optic element (31, 231)) is 9 millimeters. The light outlet surfaces (34, 234) in the practical example have at least roughly the shape of sections of an oval. They lie, for example, in a common plane. The imaginary center line of the upper light outlet surface (34) is offset downward, for example, by 7% of the height of the light outlet surface (34) relative to the imaginary center line (29) of the upper LED (20). The center line of the lower light outlet surface (234) is offset upward by this value relative to the corresponding LED (220). The lower edge (35) of the upper outlet surface (34) and the upper edge (235) of the lower light outlet surface (234) each have two sections (36, 37; 236, 237), offset relative to each other in height, which are connected to each other by means of a connection section (38, 238). These edges (35, 235) form a partition (35, 235), in which the light outlet surfaces (34, 234) are in contact with each other. The contact length corresponds to the total length of the corresponding edges (35, 235). The length of partition (35, 235) here is 66% of the length of the fiber-optic element (31, 231).

The side surfaces (41, 43; 241, 243) of the individual fiber-optic element (31; 231) are arranged in mirror image fashion relative to each other. They each include a flat surface section (42, 44; 242, 244). These surface sections (42, 44; 242, 244) lie in planes that enclose an angle of 13 degrees with each other, oriented in the direction of the corresponding fiber-optic element (31; 231). The imaginary intersection line of the planes of the upper fiber-optic element (31) lies below the fiber-optic element (31), the intersection line of the planes of the lower fiber-optic element (231) is arranged above the lower fiber-optic element (231). The surface sections (42, 44; 242, 244) designated as flat surface sections (42, 44; 242, 244) can also be twisted, for example, in the longitudinal direction.

The boundary surfaces (51, 251) of the two elements (31, 231) facing away from each other will be referred to subsequently as cover surfaces (51, 251) of the fiber-optic elements (31, 231). In the depictions of FIGS. 4 and 6, the cover surface (51) of the upper fiber-optic element (31) is the boundary surface (51) on the top, the cover surface (251) of the lower fiber-optic element (231) is the lower boundary surface (251) of the fiber-optic element (231). Similarly, the surfaces (71, 271) facing each other are referred to as bottom surfaces (71, 271).

The cover surfaces (51, 251) of the fiber-optic elements (31, 231) each include in this practical example a cylindrically developed parabolic surface section (52, 252), a uniaxially bent surface section (53, 253) and a flat surface section (54, 254). These surface sections (52-54, 252-254) are arranged one behind the other in the light propagation direction (15), in which the corresponding parabolic surface section (52, 252) is adjacent to the corresponding light entry surface (32, 232) and the corresponding flat surface section (54, 254) is adjacent to the corresponding light outlet surface (34, 234). The imaginary axes of curvature of the surface sections (52, 53) lie parallel to the upper edge (33) of the light entry surface (32), the imaginary axes of curvature of the surface sections (252, 253) lie parallel to the lower edge (233) of the light entry surface (232).

The length of the parabolic surface sections (52, 252) is 30% of the length of the corresponding cover surface (51, 251). The corresponding focal line (55, 255) of the corresponding parabolic surface in this practical example lies in the center in the corresponding light entry surface (32, 232). The focal line (55) is oriented parallel to the upper edge (33) of the light entry surface (32), the focal line (255), for example, is oriented parallel to the lower edge (233) of the light entry surface (232) and intersects the corresponding center axis (29, 229). The parabolic surface section (52) is therefore curved mathematically negatively, i.e., clockwise, with reference to the light propagation direction (15). The parabolic surface section (252) is positively curved mathematically with reference to the light propagation direction (15).

Figure 8:
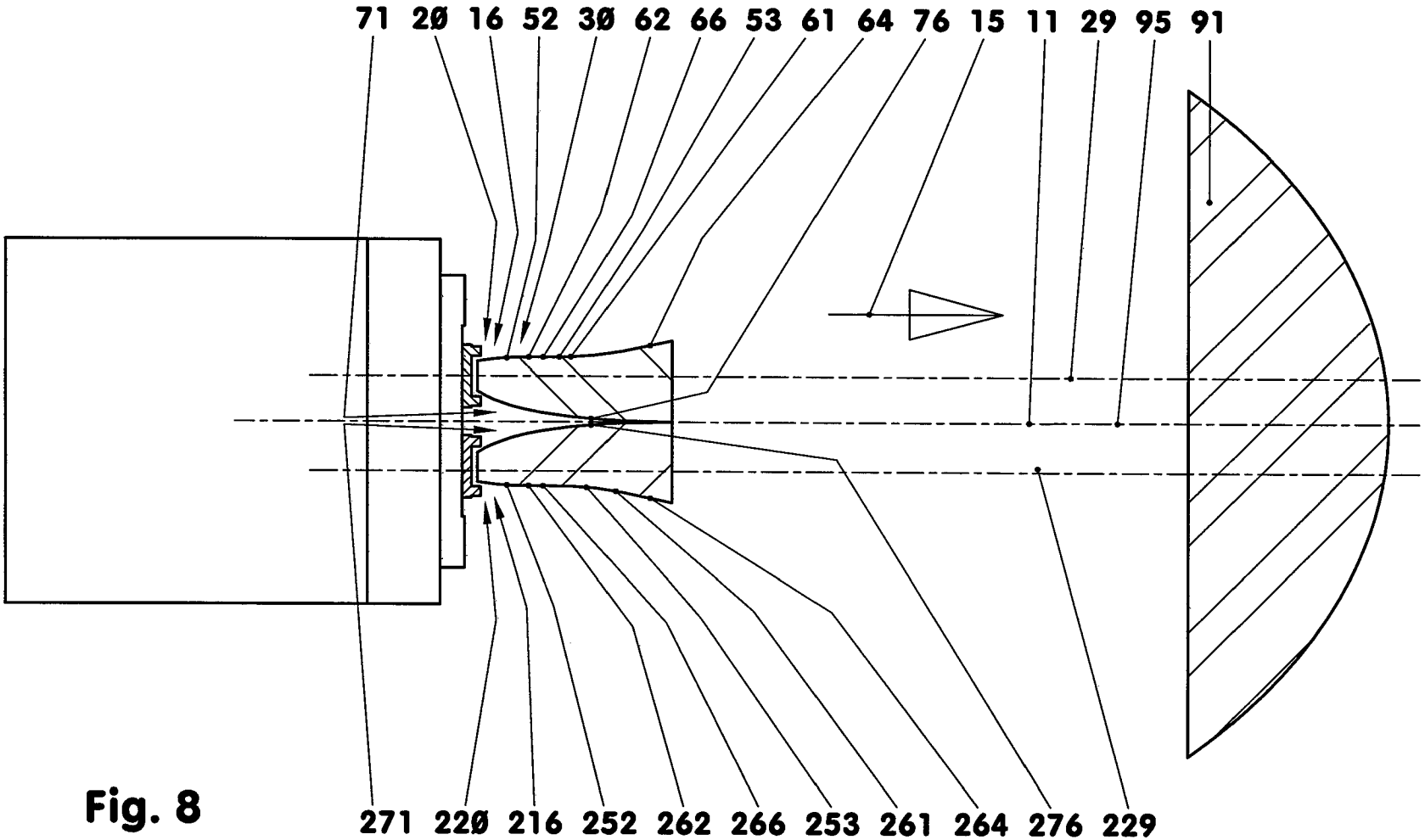
FIG. 8: Longitudinal section of a light unit.
Figure 11:
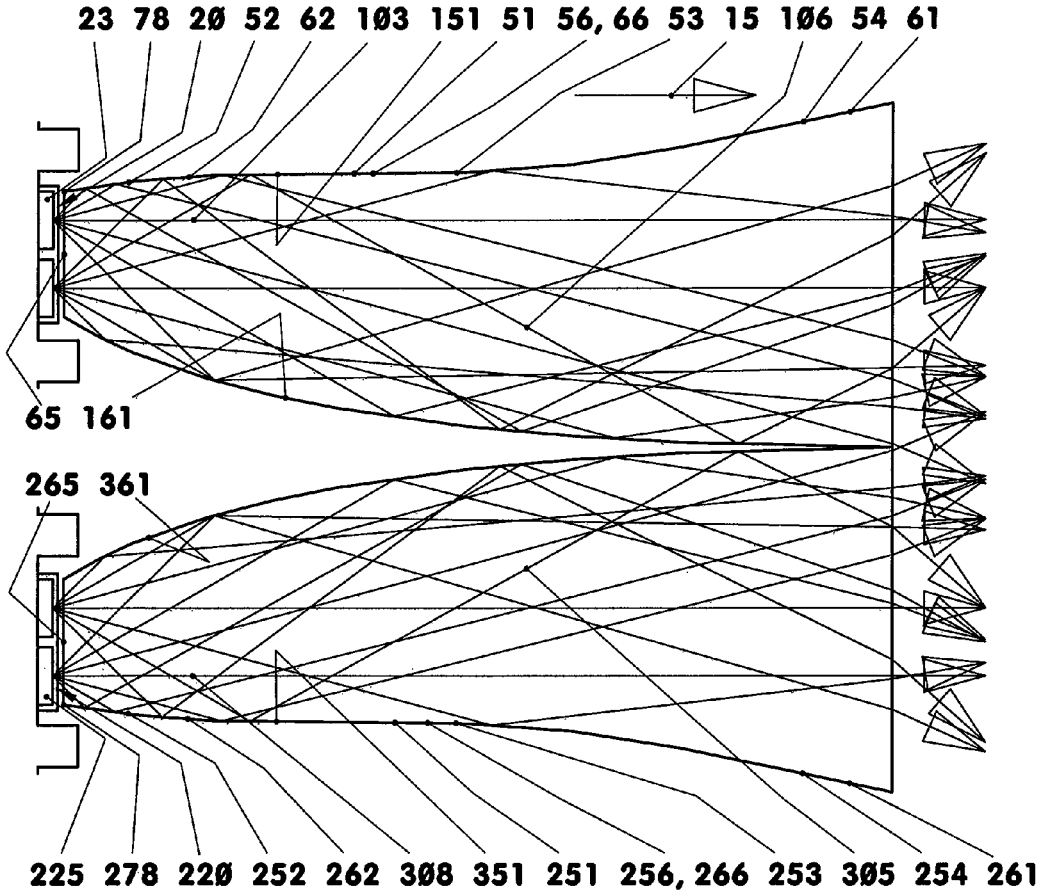
FIG. 11: Beam path into the fiber-optic element.

In FIGS. 8 and 11, the cover surfaces (51, 251) are shown in longitudinal section as curves (61, 261) and the corresponding parabolic surface section (52, 252) as a parabolic section (62, 262). The parabolic sections (62, 262) are part of second order curves. The parabolic section (62) of the upper fiber-optic element (31) is rotated, for example, by 118 degrees clockwise relative to a parabola that lies symmetric to the upward-oriented ordinate of a Cartesian coordinate system lying in the plane of the drawing. The imaginary rotation point of the parabola (and the coordinate system referred to the parabola) is the focus (65) as a point of focal line (55). The abscissa of the parabola-referred coordinate system is the directrix of the parabola, the ordinate intersects focal line (55). The distance from the focus to the origin of the parabola-referred coordinate system in this practical example is 1.49 millimeters. With y as ordinate value and x as abscissa value of the parallel-referred coordinate system, the parabola depicted here has at least roughly the equation: $y=0.15*x^2+x$. The parabolic section (262) of the lower fiber-optic element (231) is rotated accordingly in the opposite direction.

The length of the bent surface sections (53, 253) is 45% of the length of the fiber-optic element (31, 231). The bending radius corresponds to two and one-half times the length of the fiber-optic element (31, 231). The bending lines lie outside the fiber-optic elements (31, 231) on the side of the corresponding cover surface (51, 251). The surface section (53) of the upper fiber-optic element (31) is therefore curved mathematically positively counterclockwise in the depiction of FIGS. 8 and 11. The surface section (253) of the lower fiber-optic element (231) is curved mathematically negatively accordingly. The transitions between the parabolic surface sections (52, 252) and the bent surface sections (53, 253) are tangential. The cover surfaces (51, 251) in these transitions each have an inflection line (56, 256). In longitudinal section, cf. FIGS. 8 and 11, the curves (61, 261) each have an inflection point (66, 266).

The bent surface sections (53, 253) grade into the flat surface sections (54, 254). The latter enclose an angle of 12 degrees with a plane normal to the light entry surface (32; 232), in which the upper edge (33) or the lower edge (233)

lies. In longitudinal section, the curves (61, 261) here each have a straight section (64, 264).

The upper longitudinal edges of the upper fiber-optic element (31) and the lower longitudinal edges of the lower fiber-optic element (231) are rounded. The radius of rounding increases in the light propagation direction (15), for example, linearly, from zero millimeters to four millimeters. The roundings (57, 257) can also be designed continuous in areas. They grade tangentially into the bordering surfaces (41, 51; 43, 51; 241, 251; 243, 251). These transitions are shown as edges for clarification in FIGS. 6 and 7 and in FIG. 9.

The corresponding bottom surface (71, 271) of the fiber-optic elements (31, 231) in this practical example includes two parabolic surface sections (72, 73; 272, 273), offset relative to each other, which are developed cylindrically. The two parabolic surface sections (72, 73) of the upper fiber-optic element (31) are rotated relative to each other around a common axis, for example, the upper edge (33) of light entry surface (32). The angle of rotation in this practical example is 2 degrees, in which the parabolic surface section (73) situated to the left in the light propagation direction (15) protrudes farther from the fiber-optic element (31) than the parabolic surface section (72) situated to the right. The two parabolic surface sections (72, 73) have a common focal line (74), which coincides, for example, with the upper edge (33) of the light entry surface (72). The parabolic surface sections (272, 273) of the lower fiber-optic element (231) in this practical example are rotated relative to each other by the same angle as the parabolic surface section (72, 73), in which the parabolic surface section (272) situated to the right in the light propagation direction (15) protrudes farther from the fiber-optic element (231) than the parabolic surface section (273) situated to the left. These two parabolic surface sections (272, 273) also have a common focal line (274) that coincides with the upper edge (233) of light entry surface (232). The outlets of all parabolic surface sections (72, 73; 272, 273) on the light outlet surface (34, 234) lie parallel to optical axis (11). The parabolic surface section (72) is in contact with the lower edge section (36), the parabolic surface section (73) with the lower edge section (37), the parabolic surface section (272) with the lower edge section (236) and the parabolic surface section (273) with the lower edge section (237).

In the longitudinal section depicted in FIGS. 8 and 11, the parabolic surface sections (72, 272) are the parabolic sections (76, 276). The corresponding parabola of the parabolic surface section (72) is rotated by 71.5 degrees clockwise relative to a parabola that lies symmetric to the upward-oriented ordinate of a Cartesian coordinate system lying in the plane of the drawing. The imaginary rotation point of the parabola and of the coordinate system referred to the parabola is the focus (78) as a point of focal line (74). The abscissa of the parabola-referred coordinate system is the directrix of the parabola, the ordinate intersects the focus (78). The distance from the focus (78) to the origin of the parabola-referred coordinate system in this practical example is 2.59 millimeters. With y as ordinate value and x as abscissa value of the parabola-referred coordinate system, the parabola depicted here has at least roughly the equation: $y=0.17*x^2+0.15*x+1.05$. The corresponding parabola of the lower parabolic surface section (272) is rotated in the opposite direction.

A transitional region (75, 275) in this practical example lies between the two parabolic surface sections (72, 73; 272, 273). These transitional regions (75, 275) are arranged at least roughly in the center along the corresponding bottom surface (71, 271). They enclose an angle of 135 degrees with the adjacent parabolic surface sections (72, 73; 272, 273). The height of the transitional regions (75, 275) therefore increases in the light propagation direction (15). In this practical example, the height of the transitional regions (75, 275) on the transitional sections (38, 238) of the light outlet surface (34, 234) is 0.5 millimeter. The transitional regions (75, 275) can optionally have transitional radii (77). In the practical example, the transitional areas (75, 275) intersect the optical axis (11) on the light outlet surfaces (34, 234). The transitional regions (75, 275) can be offset relative to the optical axis (11). The light outlet surfaces (34, 234) adjacent to each other therefore produce a large coherent surface with a continuous partition (35, 235). The two fiber-optic elements (31, 231) can optionally be spaced relative to each other, in which the maximum spacing is less than 5 millimeters.

The optical lens (81) of primary optics (30) is, for example, a planoconvex aspherical convex lens (81), for example, a condenser lens. The flat side (82) of lens (81), in the depiction of FIGS. 1 and 2, lies on the light outlet surface (34, 234) of fiber-optic element (31, 231). The optical lens (81) can be integrated in one of the fiber-optic elements (31, 231). The maximum diameter of the optical lens (81), for example, is 30% greater than the length of the fiber-optic element (31, 231). The longitudinal section of the optical lens (81) is a segment of an ellipse, whose major axis is two and one-half times, and whose minor axis is 160% of the length of the fiber-optic element (31, 231). The thickness of the optical lens (81) is 50% of the length of the fiber-optic element (31, 231). The light module (10) can optionally be designed without optical lens (81), cf. FIGS. 8 and 10.

The secondary optical (90) in this practical example includes a secondary lens (91). This, for example, is an aspherical planoconvex lens. The envelope shape of this lens is a spherical section. The center line (95) of the secondary lens (91) lies on optical axis (11). The radius of the spherical section in the depiction of FIGS. 1 and 2 is 240% and the height 110% of the length of the fiber-optic element (31, 231). The maximum distance from the flat surface (92) to the light outlet surface (93), the thickness of secondary lens (91), corresponds to the length of the fiber-optic element (31, 231). The distance from the secondary lens (91) to the light outlet surface (34, 234) of fiber-optic element (31, 231), for example, is 260% of the length of the fiber-optic element (31, 231).

During operation of light module (10), light (100) is emitted, for example, from all light sources (22-25; 222-225) and passes through the light entry surfaces (32; 232) into the fiber-optic elements (21, 231). Each light-emitting chip (22-25; 222-225) acts as a Lambert emitter, which emits light (100) in the half-space. The light of the upper LED (20) then enters only the upper fiber-optic element (31), the light of the lower LED (220) only the lower fiber-optic element (231).

Figure 10:
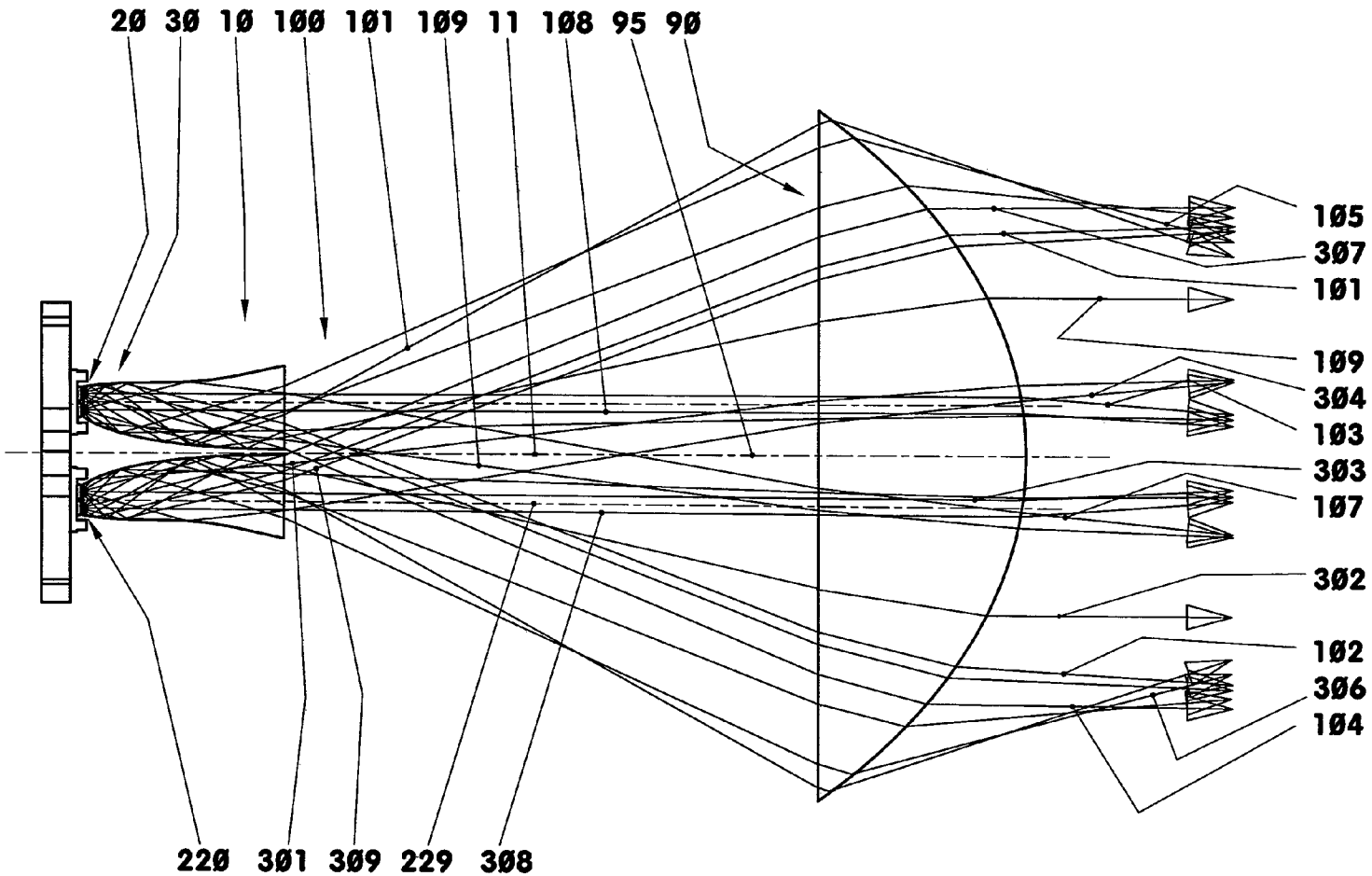
FIG. 10: Beam path of the light unit.

A beam path of a light module (10) is shown as an example in FIG. 10 in the longitudinal section of light module (10). The light module (10) depicted here corresponds to the light module (10) depicted in FIG. 8. The beam path within the fiber-optic element (31, 231) is shown enlarged in FIG. 11.

Light beams (101-109; 301-309) are shown as examples in FIGS. 10 and 11, which are emitted by two light-emitting chips (23, 25; 223, 225) arranged one above the other. The light-emitting chips (23, 24; 223, 225) are shown as point-like light sources here. The light beams (101-105) from the upper light-emitting chip (23) of the upper LED (20) are shown, which are emitted offset relative to each other by 15 degrees. The light beam (101) is emitted upward by 45 degrees, whereas light beam (105) is emitted downward relative to optical axis (11) by 45 degrees. The corresponding light beams of the lower light-emitting chip (25) of upper LED (20) are the light beams (106-109). In the lower LED (220), the light beams (301-305) from the upper light-emitting chip (223) and the light beams (306-309) from the lower light-emitting chip (225) are shown. Only the beam path of the light of the upper LED (20) is described subsequently, the beam path of the light of the lower LED (20) is a mirror image to it.

Light (103), emitted parallel to optical axis (11) from upper light-emitting chip (23), passes through the light outlet surface (34) of fiber-optic element (31) in the normal direction. It impinges on the flat surface (92) of secondary lens (91), also in the normal direction, passes through secondary lens (91) and, on emerging from secondary lens (91), is refracted away from the perpendicular at the passage point.

The light beams (102) emitted from the upper light-emitting chips (23), which enclose an angle of 15 degrees and 30 degrees with the optical axis (11) directed upward, impinge on an upper interface (151) of fiber-optic element (31). This upper interface (151) is formed by the cover surface (51) and has, at a maximum, its size. The corresponding impingement point here lies in the area of parabolic surface (52). The impinging light beams (102) enclose with the normal an angle at the impingement point that is greater than the critical angle of total reflection for the transition of the material of fiber-optic element (31) with air. The upper interface (151) therefore forms a total reflection surface (151) for the impinging light (102). The reflected light beams (102) pass through the light outlet surface (34), during which they are refracted away from the perpendicular at the passage point. On entering the secondary lens (91), the roughly parallel light beams (102) are refracted in the direction of the perpendicular at the corresponding passage point and refracted away from the perpendicular on emerging into the surroundings (1). The depicted light beams (102) here enter the surroundings (1) in the lower segment of secondary lens (91).

Light (101), which is emitted under an upward-directed angle of 45 degrees from the upper light-emitting chip (23), is initially reflected on the upper total reflection surface (151). The reflected light (101) impinges on the lower interface (161). The impingement angle of light (101) and the normal at the impingement point enclose an angle that is greater than the critical angle of total reflection. The lower boundary surface (161) therefore acts as a lower total reflection surface (161) for the impinging light (101). The light (101) reflected at this total reflection surface (161) passes through light outlet surface (34) and secondary lens (91), in which it is refracted during passage through the corresponding interfaces (34, 92, 93). This light (101) enters the surroundings (1) in the upper segment of secondary lens (91).

The light beam (104) of the upper light-emitting chip (23) depicted in FIGS. 10 and 11, which encloses a downward-directed angle of 15 degrees with optical axis (11), is not reflected in the fiber-optic element (31). On passing through the light outlet surface (34) and through secondary lens (91), it is refracted. This light beam (104) lies in the lower segment of secondary lens (91).

The light (105) emitted in the mentioned FIGS. 10 and 11, under a downward-directed angle of 30 degrees and 45 degrees to the optical axis (11), is totally reflected on the lower interface (161) and passes through the light outlet surface (34) and secondary (91) with refraction into the surroundings (1). This light (105) lies in the upper segment of secondary lens (91).

The light (108) emitted from the lower light-emitting chip (25) parallel to optical axis (11) is at least roughly parallel to the light (103) of the upper light-emitting chip (23).

Light (107), emitted under an upper-directed angle of 15 degrees, impinges on the upper interface (151) in the area of inflection line (56). It is fully reflected here and passes with refraction through the light outlet surface (34) and the lower segment of secondary lens (91) into the surroundings (1).

The light beams (106), emitted in FIGS. 10 and 11 under 30 degrees and 45 degrees to the optical axis (11) upward from light-emitting chip (25), are reflected on the upper (151) and lower interface (161).

The light beams (109) of the lower light-emitting chip (25), which include a downward-directed angle of 15, 30 and 45 degrees with optical axis (11), are reflected on the lower interface (161). During refraction, they pass through the light outlet surface (34) and the secondary lens (91). For example, light beams (109) emerging into surroundings (1) are roughly symmetric to optical axis (11).

Of the total light (100) emitted from light sources (22-25), 48% is reflected in this practical example on the lower interface (161) and 26% of the light is reflected on the upper interface (151).

In the top view, cf. FIG. 2, the light bundle (100) is widened, for example, to an angle of 17 degrees.

Figure 12:
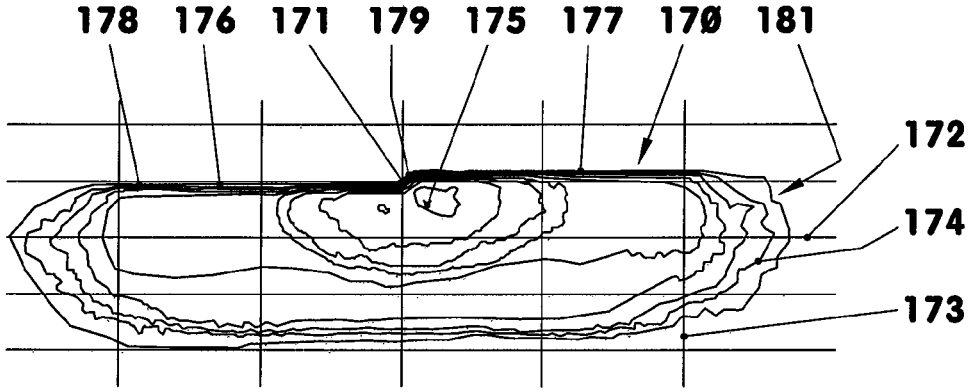
FIG. 12: Light distribution diagram during operation with an LED.

The illumination intensity distribution (170) generated by light module (10) during operation only with upper LED (20), for example, on a wall 25 meters away, is shown in FIG. 12. The optical axis (11) of the light module (10) passes through the measurement wall, for example, at intersection point (171) of two reference grid lines (172, 173). In this depiction, the horizontal grid lines (172) on the measurement wall have a spacing of two meters. The spacings of the vertical grid lines (173) relative to each other are five meters here. The individual isolines (174) are lines of equal illumination intensity. The illumination intensity, measured in lux or in lumen per square meter, increases in this diagram from the outside in. An inner isoline (174), for example, has 1.8-times the illumination intensity of an isoline situated farther out.

The secondary lens (91) images the light outlet surface (34) or (83) of primary optics (30) on the measurement wall. This light outlet surface (34; 83) can be the light outlet surface (34) of fiber-optic element (31) or the convex surface (83) of condenser lens (81). The area (175) of highest illumination intensity, the so-called hot spot (175), lies here on the right beneath intersection point (177). Upward, the illumination intensity rapidly diminishes at the light-dark boundary (176). The light-dark boundary (176) is formed z-shaped here. In this depiction, it has a higher section (177) on the right and a lower-lying section (178) on the left. Both sections (177, 178) are connected to each other by a connection section (179), which encloses an angle of, say, 135 degrees with the two other sections (177, 178). At this light-dark boundary (176), the lower edge (35) of the light outlet surface (34) of the primary optics (30) is imaged.

The illumination intensity distribution depicted in FIG. 12 exhibits a broad illuminated region (181), whose illumination intensity diminishes in width only with a distance of more than 15 meters from point of intersection (171). Downward, the illuminated area (181) has a height of, say, 4 to 5 meters.

During operation of light module (10) or several light modules (10), an indistinctly limited, illuminated area (181), free of strips and spots, is produced with a sharp, z-shaped light-dark boundary (176). During operation of light module (10) only with the upper LED (20), the low beam of a vehicle can therefore be generated.

Figure 13:
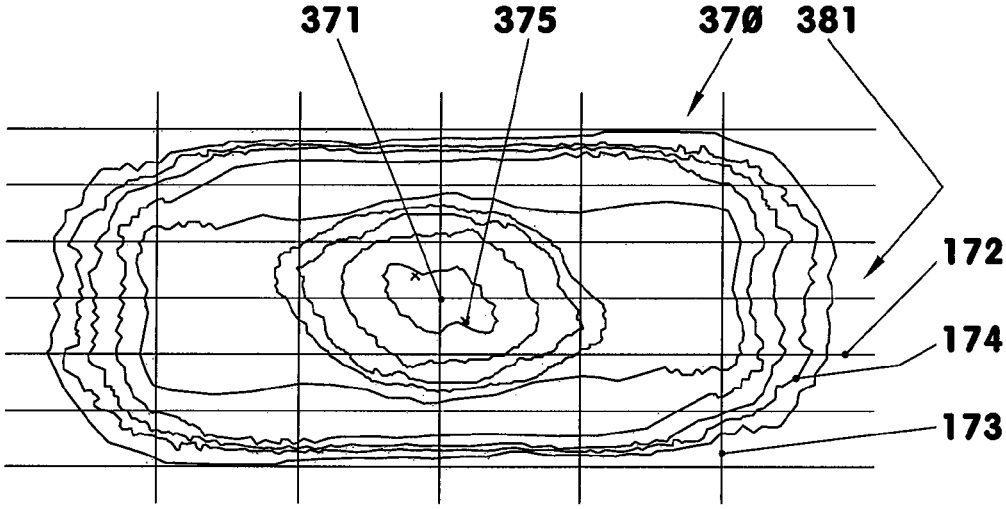
FIG. 13: Light distribution diagram of the light unit.

If the lower LED (220) is added, the illumination intensity distribution (370) depicted in FIG. 13 is obtained. This distribution (370) is at least roughly symmetric to a horizontal that intersects the intersection point (371) of the optical axis (11) with measurement wall. The hot spot (375) is a large-surface spot and extends upward and downward beyond the mentioned horizontal line. The illumination width of a light module (10), operated with both LEDs (20, 220), is therefore higher than the illumination width of a light module (10), operated only with the upper LED (20). This light module (10) can therefore be used to produce a high beam.

The light module (10) depicted in the practical examples, because of its geometric configuration, has high light output and requires only limited space. The relative decoupling efficiency attainable with such a light module (10) without additional reflections lies at 97% of the maximum possible decoupling efficiency. This corresponds to the absolute value of 80% to 82%.

In order to change the height position of light distribution, the parabolic surface section (72, 73; 272, 273) can be rotated around a corresponding focal line (4, 274). In the view according to FIG. 8, rotation of parabolic surfaces (72, 73) of the upper light distribution element (31) clockwise causes an increase in light distribution. At the same time, if the optical axis (11) is not shifted, the light-dark boundary (176) can be shifted upward. The intensity of the hot spot (175, 375) is retained here.

The light distribution on the measurement wall is obtained by overlapping of different light fractions, cf. FIG. 10. For example, the hot spot (175) is produced by overlapping of light fractions, which is limited downward and upward from the upper light-emitting chip (23) in a segment between 0 degrees and 15 degrees with light fractions that are limited from the lower light-emitting chip (23) between 0 degrees and 15 degrees upward and between 30 degrees and 45 degrees downward. To generate hot spot (375), the corresponding light fractions of lower LED (220) additionally contribute.

In order to change the intensity of the corresponding hot spot (175, 375), the parabolic surface section (52, 252) can be changed. For example, viewed in the longitudinal section of the fiber-optic element (31), rotation of the parabolic surface section (52) clockwise means a weakening of intensity. A change in outlet (54, 254) of cover surfaces (51, 251) changes the gradient of the light intensity distribution.

By shifting the start of the connection area, the height of the illumination intensity at the hot spot (175, 375) and around the hot spot (175, 375) can also be deliberately controlled. An unfavorable choice can cause weakening of the hot spot (175, 375).

The light (100) emerging from the light outlet surfaces (34, 234) can be additionally bundled by means of condenser lens (81). Therefore a secondary lens (91) of limited diameter can be used. The convex surface (83) of the condenser lens (81), for example, is an aspherical surface.

The distance from the secondary optics (90) to the primary optics (30) also influences the illumination intensity distribution. In order to bundle the light (100) emerging divergently from the primary optics (30) by great distance, a larger secondary lens (91) is required than in small spacing. The larger secondary lens (91) (with identical fiber-optic elements (31, 231)) permits formation of hot spot (175, 375), whereas to form an ambient light distribution, a smaller spacing is required between primary optics (30) and secondary optics (90) and a smaller secondary lens (91).

The light distribution on the sides of the illuminated areas (181, 381) can be influenced by the side surfaces (41, 43; 241, 243) and the roundings (57, 257). A rotation of the side surfaces (41, 43; 241, 243) with fixed edges (35, 235) relative to each other reduces the width of the light distribution diagrams (171, 371), cf. FIGS. 12 and 13. A reduction of the radii of roundings (57, 257) causes a sharper transition from the illuminated to unilluminated area in the corners.

Figure 14:
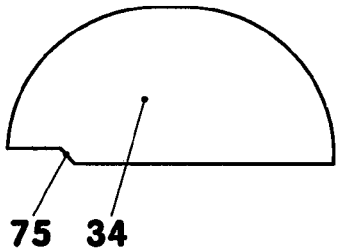
FIG. 14: Light outlet surface with offset transitional region.

A light outlet surface (34) of a fiber-optic element (31) is shown in FIG. 14. The main dimensions of this light outlet surface (34) correspond to the main dimensions of the low (34) depicted in FIG. 5. The transitional region (75) between the parabolic surfaces (72, 73) is shifted leftward in comparison with FIG. 5. During installation of several light modules (10), these are arranged, so that during operation, the connection sections (179) coincide. Two asymmetrically divided illumination profiles therefore overlap only partially. In the center, in the region of the desired hot spot (175), and at the z-shaped light-dark boundary (176), an area of higher illumination intensity is thus achieved, in comparison with the side areas. The lower fiber-optic element, not shown here, has a transitional region offset leftward by the same amount, in comparison with the depiction in FIG. 5.

Figure 15:
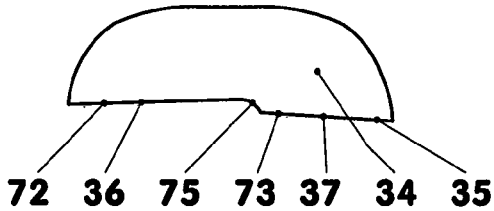
FIG. 15: Light outlet surface with curved lower edges.

The two parabolic surfaces (72, 73), as shown in FIG. 15, can be sloped relative to each other. Distorted images in the target plane can be compensated by this. The parabolic surfaces (72, 73) can also be arched in the transverse direction. They can optionally be additionally modified in the third of the fiber-optic element (31) adjacent to the light outlet surface (34). The lower fiber-optic element, not shown here, is adapted accordingly, so that both elements have a partition of at least roughly constant width at the light outlet surface.

The fiber-optic element (31) can also include two parabolic surfaces (72, 73) on the bottom, which are directly adjacent to each other and are sloped to each other by 15 degrees. Illumination with a 15-degree rise can be produced with this.

Figure 9:
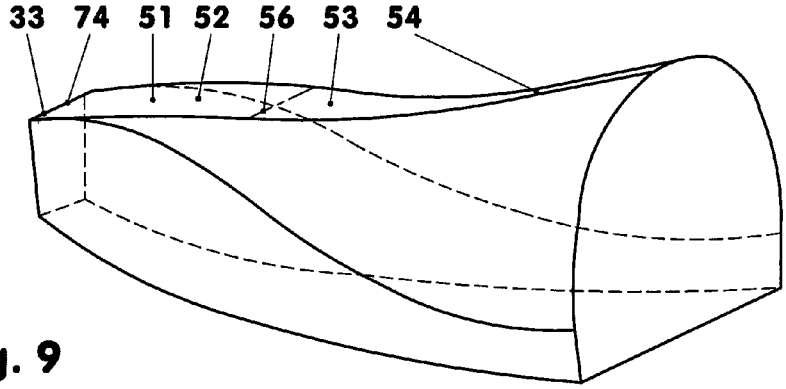
FIG. 9: View of a fiber-optic element obliquely from above.

It is also conceivable to make the bottom surface (71) with only one continuous parabolic surface (72; 73), cf. FIG. 9. The lower edge (35) of the light outlet surface (34) is horizontal. The corresponding lower fiber-optic element, not shown here, also has a horizontal edge of the light outlet surface. With such a light module (10), for example, during operation only with the upper LED (20), a horizontal light-dark boundary (176) of the low beam is generated. The corresponding light module (10) can be designed here, so that a hot spot (175) is generated. When the lower LED is connected, the high beam is switched on. In this practical example, the cover surface (51) also has a parabolic surface section (52), a bent surface section (53) and a flat surface section (54). An inflection line (56) lies between the parabolic surface section (52) and the bent surface section (54).

The bottom surface (71, 271) can be described, at least in areas, by a family of adjacent parabolas oriented in the light propagation direction (15). These parabolas can have different parameters.

The two fiber-optic elements (31, 231) can have different dimensions and/or different curvatures of the corresponding surfaces.

The surfaces described here can be envelope surfaces. The individual surface sections can be free-form surfaces, for example, whose envelope surfaces are parabolic surfaces. The focal line 55, 74; 255, 274) can be shifted, for example, in the light propagation direction (15).

It is also conceivable to design the parabolic surface sections (52, 252) of cover surfaces (51, 251) with individual stages. From each two adjacent interface sections of the fiber-optic element (31, 231), a boundary surface section therefore includes a parabolic surface, like total reflection surface (151, 351), for the light (101-105, 306-309) emitted from the light-emitting chip (23; 225), whereas the other interface section includes a total reflection surface for the light (106-109, 301-

305) emitted from the light-emitting chip (25, 223). The bottom surface (71, 271) can optionally also be designed stepped.

LIST OF REFERENCE NUMBERS

1 Surroundings
10 Light unit, light module
11 Optical axes
15 Light propagation direction
16, 216 Intermediate spaces
20, 220 LEDs, luminescent diodes
21, 221 Group of light sources
22-25 Light sources, light-emitting chips of (20)
222-225 Light sources, light-emitting chips of (220)
26 Base
29, 229 Center lines of (20; 220)
30 Primary optics
31, 231 Fiber-optic element
32, 232 Light entry surfaces
33, 233 Edges of (32, 232)
34, 234 Light outlet surfaces
35, 235 Partition, edges of (34; 234)
36, 236 Sections of (35, 235)
37, 237 Sections of (35; 235)
38, 238 Transitional sections of (35; 235)
41, 241 Side surfaces
42, 242 Flat surface sections
43, 243 Side surfaces
44, 244 Flat surface sections
51, 251 Cover surface
52, 252 Parabolic surface sections
53, 253 Bent surface sections
54, 254 Flat surface sections; outlets for (51, 251)
55, 255 Focal lines
56, 256 Inflection lines
57, 257 Roundings
61, 261 Curves
62, 262 Curve sections, parabolic sections
64, 264 Straight sections
65, 256 Foci of (62; 262)
66, 266 Inflection points
71, 271 Bottom surface
72, 272 Parabolic surface sections
73, 273 Parabolic surface sections
74, 274 Focal lines
75, 275 Transitional areas
76, 276 Curve sections, parabolic sections
77 Transitional radius
78, 278 Foci of (76; 276)
81 Optical lens, convex lens, condenser lens
82 Flat side
83 Convex surface, light outlet surface of (81)
90 Secondary optics
91 Secondary lens
92 Flat surface
93 Light outlet surface
95 Center line of (91)
100 Light, light bundle
101-105 Light beams of (23)
301-305 Light beams of (223)
106-109 Light beams of (25)
306-309 Light beams of (225)
151, 351 Interfaces, total reflection surfaces
161, 361 Interfaces, total reflection surfaces
170, 370 Illumination intensity distributions
171, 371 Intersection points
172 Reference grid lines, horizontal
173 Reference grid lines, vertical
174 Isolines
175, 375 Areas of highest illumination intensity, hot spots
176 Light-dark boundary
177 Section of (176)
178 Section of (176)
179 Connection section
181, 381 Illuminated areas

The invention claimed is:

1. A light unit (10) comprising:

a first light emitting chip (22-25) including a first LED (20) as a first light source;

a second light emitting chip (222-225) including a second LED (220) as a second light source;

primary optics (30) optically connected after said first (20) and second (220) LEDs, said primary optics (30) include a first fiber-optic element (31) and a second fiber-optic element (231), each of said first (31) and second (231) fiber-optic elements defining first (32) and second (232) light entry surfaces, first (51) and second (251) cover surfaces, first (71) and second (271) bottom surfaces, and first (34) and second (234) light outlet surfaces, respectively, such that at least one of said cover surfaces (51,251) and said bottom surfaces (71,271) has at least two curved surfaces (72, 73; 272, 273) arranged offset relative to each other forming in between, an angled transition area (75, 275) that extends between the two curved surfaces (72, 73; 272, 273) and also extends between the first (32) and second (232) light entry surfaces and the first (34) and second (234) light outlet surfaces wherein said first (34) and second (234) light outlet surfaces are adjacent to each other along a partition (35,235); and secondary optics (90) optically connected to said first (34) and second (234) light outlet surfaces to receive the light from said first (20) and second (220) light sources after the light passes through said primary optics (30).

2. Light unit (10) according to claim 1, characterized by the fact that the two surfaces (51, 71; 251, 271) bordering the fiber-optic elements (31, 231) have oppositely curved surface sections (52, 72; 252, 272).

3. Light unit (10) according to claim 2, characterized by the fact that the first LED (20; 220) includes a group (21; 221) of light-emitting chips (22-25; 222-225) as light sources.

4. Light unit (10) according to claim 3, characterized by the fact that in each group (21, 221) of light-emitting chips (22-25; 222-225), they are arranged, so that each light-emitting chip (22-25; 222-225) within group (21; 221) has at least two directly adjacent light-emitting chips (23, 24; 22, 25; 22, 25; 23, 24; 223, 224; 222, 225; 222, 225; 223, 224).

5. Light unit (10) according to claim 2, characterized by the fact that the light outlet surfaces (34, 234) lie in a plane.

6. Light unit (10) according to claim 5, characterized by the fact that the plane of the light outlet surfaces (34, 234) is arranged normal to the optical axis (11) of light unit (10).

7. Light unit (10) according to claim 2, characterized by the fact that the main dimensions of the fiber-optic elements (31, 231) are identical.

8. Light unit (10) according to claim 7, characterized by the fact that the length of the partition (35, 235) is at least 50% of the length of the fiber-optic element (31).

9. Light unit (10) according to claim 2, characterized by the fact that the primary optics (30) includes a condenser lens (81), optically connected after the fiber-optic elements (31, 231).

10. Light unit (10) according to claim 2, characterized by the fact that the geometric center line (95) of secondary optics (90) coincides with the optical axis (11) of light unit (10).

11. Light unit (10) according to claim 2, characterized by the fact that the surface sections (52, 72; 252, 272) are curved parabolically.

12. Light unit (10) according to claim 11, characterized by the fact that the corresponding transitional area (75, 275) encloses an angle of 135 degrees with the two surface sections (72, 73; 272, 273).

* * * * *